US008941319B2

(12) United States Patent
Gao et al.

(10) Patent No.: US 8,941,319 B2
(45) Date of Patent: Jan. 27, 2015

(54) LED CONSTANT-CURRENT DRIVE CIRCUIT

(75) Inventors: Yuan Gao, Shenzhen (CN); Yubo Qiao, Shenzhen (CN)

(73) Assignee: Shenzhen Fuxinya Technology Development Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 13/505,457

(22) PCT Filed: Feb. 13, 2012

(86) PCT No.: PCT/CN2012/071060

§ 371 (c)(1),
(2), (4) Date: May 2, 2012

(87) PCT Pub. No.: WO2012/155550

PCT Pub. Date: Nov. 22, 2012

(65) Prior Publication Data

US 2014/0070715 A1 Mar. 13, 2014

(30) Foreign Application Priority Data

May 19, 2011 (CN) ..... 2011 1 0129551

(51) Int. Cl.
*H05B 33/08* (2006.01)
*H05B 37/02* (2006.01)

(52) U.S. Cl.
CPC ..... *H05B 33/0809* (2013.01)
USPC ..... 315/291; 315/219; 315/225; 315/312

(58) Field of Classification Search
USPC ..... 315/291, 312, 219, 225, 247
See application file for complete search history.

(56) References Cited

U.S. PATENT DOCUMENTS

| | | | | |
|---|---|---|---|---|
| 6,388,430 | B1 * | 5/2002 | Eldridge | 323/255 |
| 2007/0267984 | A1 * | 11/2007 | Peng | 315/312 |
| 2008/0203934 | A1 * | 8/2008 | Van Meurs | 315/224 |
| 2010/0134038 | A1 * | 6/2010 | Shackle et al. | 315/291 |
| 2011/0148318 | A1 * | 6/2011 | Shackle et al. | 315/291 |
| 2012/0019218 | A1 * | 1/2012 | Fang et al. | 323/271 |
| 2012/0074865 | A1 * | 3/2012 | Lee et al. | 315/291 |

OTHER PUBLICATIONS

STIC Search Report of May 7, 2014.*

* cited by examiner

*Primary Examiner* — Douglas W Owens
*Assistant Examiner* — Pedro C Fernandez

(57) ABSTRACT

An LED constant-current drive circuit includes a BUCK circuit consisting of a transformer T1, a diode D9, a capacitor C5 and a field effect transistor Q1; a voltage limiting circuit consisting of a resistor R1, a diode D8, a capacitor C1, a resistor R3, a triode Q2, a zener diode DZ1 and a diode D10; and a current limiting circuit consisting of a resistor R4, a triode Q3, a triode Q4 and a resistor R2. When the transistor Q1 is turned on, a current flows through a primary side of the transformer T1 and an LED load, and then flows through the transistor Q1 and the resistor R2, and then flows back to a negative electrode of a power supply. When the transistor Q1 is turned off, the current flows through the primary side of the transformer T1, the LED load and the diode D9, thus forming a loop.

8 Claims, 1 Drawing Sheet

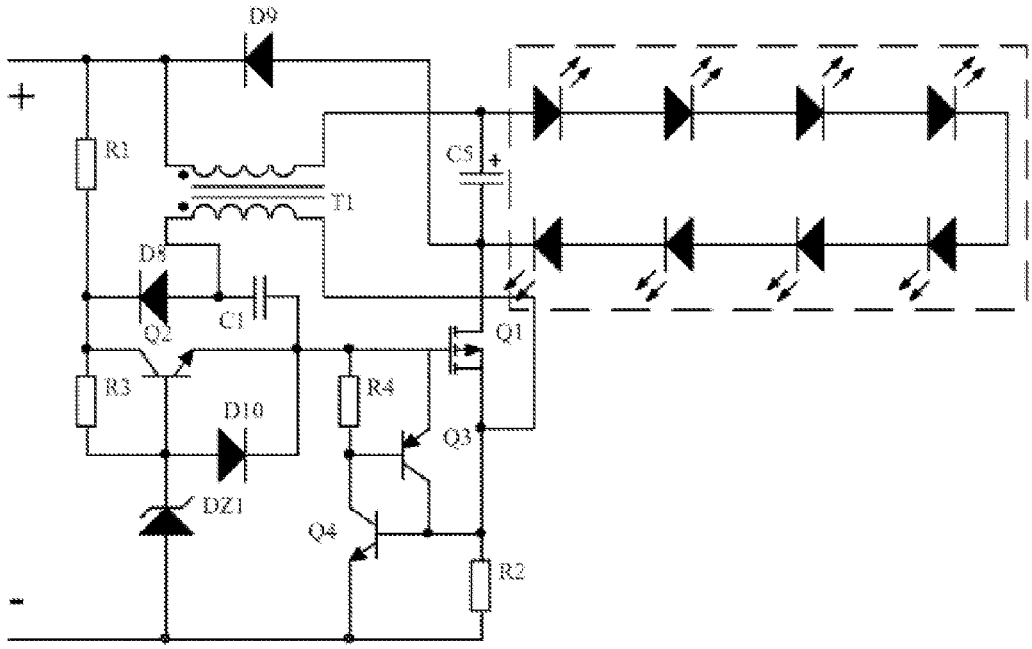
D9
+
R1
C5
T1
D8
C1
Q2
Q1
R3
R4
D10
Q3
DZ1
Q4
R2
-

LED CONSTANT-CURRENT DRIVE CIRCUIT

BACKGROUND OF THE PRESENT INVENTION

1. Field of Invention

The present invention relates to an LED (light emitting diode) drive circuit, and more particularly to an LED constant-current drive circuit.

2. Description of Related Arts

LEDs are quickly applied to all areas for long service life, high luminous efficiency, low power consumption and no radiation characteristics in our daily life. However, the PN junction of the LEDs also has the same characteristic of that of the diode (nonlinearity) and has a negative temperature coefficient. Therefore, while using the LEDs, it is required for the driving power to have a high stability and a constant current characteristic. The resistance-capacitance driving circuit is a commonly used LED driving circuit. Under the high voltage, its current increases sharply, its power factor is lower and its higher harmonic is more. Currently, there are also some special LED constant-current drive chips with high stability and good constant-current characteristic on the market. However, these special LED constant-current drive chips have complicated structure, high cost and high price.

SUMMARY OF THE PRESENT INVENTION

An object of the present invention is to overcome the shortcomings of the prior art and provide an LED (light emitting diode) constant-current drive circuit with simple structure, reliable performance and low price.

Accordingly, in order to accomplish the object mentioned above, the present invention provides an LED (light emitting diode) constant-current drive circuit, comprising:

a BUCK circuit consisting of a transformer T1, a diode D9, a capacitor C5 and a field effect transistor Q1;

a voltage limiting circuit consisting of a resistor R1, a diode D8, a capacitor C1, a resistor R3, a triode Q2, a zener diode DZ1 and a diode D10; and a current limiting circuit consisting of a resistor R4, a triode Q3, a triode Q4 and a resistor R2, wherein when the field effect transistor Q1 is turned on, a current flows through a primary side of the transformer T1 and an LED load, and then flows through the field effect transistor Q1 and the resistor R2, and then flows back to a negative electrode of a power supply, and when the field effect transistor Q1 is turned off, the current flows through the primary side of the transformer T1, the LED load and the diode D9, thus forming a loop.

Also, the present invention provides an LED (light emitting diode) constant-current drive circuit comprising a resistor R1, a resistor R2, a resistor R3, a resistor R4, a capacitor C1, a capacitor C5, a transformer T1, a diode D8, a diode D9, a diode D10, a zener diode DZ1, a field effect transistor Q1, a triode Q2, a triode Q3 and a triode Q4, wherein a homonymous terminal at a primary side of the transformer T1 is connected with a positive electrode of a power supply, the other terminal at the primary side of the transformer T1 is connected with an anode of an LED load, a cathode of the LED load is connected with an anode of the diode D9 and a drain electrode of the field effect transistor Q1, a positive electrode and a negative electrode of the capacitor C5 are respectively connected with the anode and the cathode of the LED load, a cathode of the diode D9 is connected with the positive electrode of the power supply, a homonymous terminal at a secondary side of the transformer T1 is connected with an anode of the diode D8 and one end of the capacitor C1, the other end at the secondary side of the transformer T1 is connected with a source electrode of the field effect transistor Q1, the source electrode of the field effect transistor Q1 is connected with a negative electrode of the power supply via the resistor R2, a gate electrode of the field effect transistor Q1 is connected with the other end of the capacitor C1, an emitter of the triode Q2, a cathode of the diode D10, one end of the resistor R4 and an emitter of the triode Q3, a base of the triode Q3 is connected with the other end of the resistor R4 and a collector of the triode Q4, a collector of the triode Q3 is connected with the source electrode of the field effect transistor Q1 and a base of the triode Q4, an emitter of the triode Q4 is connected with the negative electrode of the power supply, a collector of the triode Q2 is connected with a cathode of the diode D8, one end of the resistor R1 and one end of the resistor R3, the other end of the resistor R1 is connected with the positive electrode of the power supply, a base of the triode Q2 is connected with the other end of the resistor R3, an anode of the diode D10 and a cathode of the zener diode DZ1, and an anode of the zener diode DZ1 is connected with the negative electrode of the power supply.

Preferably, the triode Q3 is a PNP triode, and the triodes Q2 and Q4 are NPN triodes.

Preferably, the field effect transistor Q1 is an enhanced PMOSFET (p-type metal-oxide-semiconductor field effect transistor).

Preferably, the LED load is formed by a plurality of LEDs connected with each other in series.

In the LED constant-current drive circuit of the present invention, the homonymous terminal at the primary side of the transformer is connected with the positive electrode of the power supply, the other terminal at the primary side of the transformer is connected with the anode of the LED load, the cathode of the LED load is connected with the anode of the diode D9 and the drain electrode of the field effect transistor Q1, the positive electrode and the negative electrode of the capacitor C5 are respectively connected with the anode and the cathode of the LED load, the cathode of the diode D9 is connected with the positive electrode of the power supply, the homonymous terminal at the secondary side of the transformer T1 is connected with the anode of the diode D8 and one end of the capacitor C1, the other end at the secondary side of the transformer T1 is connected with the source electrode of the field effect transistor Q1, the source electrode of the field effect transistor Q1 is connected with the negative electrode of the power supply via the resistor R2, the gate electrode of the field effect transistor Q1 is connected with the other end of the capacitor C1, the emitter of the triode Q2, the cathode of the diode D10, one end of the resistor R4 and the emitter of the triode Q3, the base of the triode Q3 is connected with the other end of the resistor R4 and the collector of the triode Q4, the collector of the triode Q3 is connected with the source electrode of the field effect transistor Q1 and the base of the triode Q4, the emitter of the triode Q4 is connected with the negative electrode of the power supply, the collector of the triode Q2 is connected with the cathode of the diode D8, one end of the resistor R1 and one end of the resistor R3, the other end of the resistor R1 is connected with the positive electrode of the power supply, the base of the triode Q2 is connected with the other end of the resistor R3, the anode of the diode D10 and the cathode of the zener diode DZ1, and the anode of the zener diode DZ1 is connected with the negative electrode of the power supply. It can be seen that the current flowing through the LED load is limited by controlling the maximum current value of the inductor current of the transformer in the LED constant-current drive circuit of the present invention. The inductor current of the transformer can not be changed suddenly, so the constant current is finally achieved by the linear variation of the inductor current of the transformer, thus forming the LED constant-current drive circuit with simple structure, reliable performance and low price, which is adapted for the civil LED lighting field.

BRIEF DESCRIPTION OF THE DRAWINGS

The drawing is a circuit schematic diagram of an LED (light emitting diode) constant-current drive circuit according to a preferred embodiment of the present invention.

DETAILED DESCRIPTION OF THE PREFERRED EMBODIMENT

The present invention is further detailedly explained with the accompanying drawings.

Referring to the drawing, an LED (light emitting diode) constant-current drive circuit according to a preferred embodiment of the present invention is illustrated, which comprises a resistor R1, a resistor R2, a resistor R3, a resistor R4, a capacitor C1, a capacitor C5, a transformer T1, a diode D8, a diode D9, a diode D10, a zener diode DZ1, an enhanced PMOSFET (p-type metal-oxide-semiconductor field effect transistor) Q1, an NPN triode Q2, a PNP triode Q3, and an NPN triode Q4. A homonymous terminal at a primary side of the transformer T1 is connected with a positive electrode of a power supply, the other terminal at the primary side of the transformer T1 is connected with an anode of an LED load (which is formed by a plurality of LEDs connected with each other in series, and can also be formed by a single LED), a cathode of the LED load is connected with an anode of the diode D9 and a drain electrode of the field effect transistor Q1, a positive electrode and a negative electrode of the capacitor C5 are respectively connected with the anode and the cathode of the LED load, a cathode of the diode D9 is connected with the positive electrode of the power supply, a homonymous terminal at a secondary side of the transformer T1 is connected with an anode of the diode D8 and one end of the capacitor C1, the other end at the secondary side of the transformer Ti is connected with a source electrode of the field effect transistor Q1, the source electrode of the field effect transistor Q1 is connected with a negative electrode of the power supply via the resistor R2, a gate electrode of the field effect transistor Q1 is connected with the other end of the capacitor C1, an emitter of the triode Q2, a cathode of the diode D10, one end of the resistor R4 and an emitter of the triode Q3, a base of the triode Q3 is connected with the other end of the resistor R4 and a collector of the triode Q4, a collector of the triode Q3 is connected with the source electrode of the field effect transistor Q1 and a base of the triode Q4, an emitter of the triode Q4 is connected with the negative electrode of the power supply, a collector of the triode Q2 is connected with a cathode of the diode D8, one end of the resistor R1 and one end of the resistor R3, the other end of the resistor R1 is connected with the positive electrode of the power supply, a base of the triode Q2 is connected with the other end of the resistor R3, an anode of the diode D10 and a cathode of the zener diode DZ1, and an anode of the zener diode DZ1 is connected with the negative electrode of the power supply.

In the LED constant-current drive circuit mentioned above, the transformer T1, the diode D9, the capacitor C5 and the field effect transistor Q1 form a buck circuit, the resistor R1, the diode D8, the capacitor C1, the resistor R3, the triode Q2, the zener diode DZ1 and the diode D10 form a voltage limiting circuit, and the resistor R4, the triode Q3, the triode Q4 and the resistor R2 form a current limiting circuit. When the field effect transistor Q1 is turned on, the current flows through the primary side of the transformer T1 and the LED load, and then flows through the field effect transistor Q1 and the resistor R2, and then flows back to the negative electrode of the power supply. When the field effect transistor Q1 is turned off, the current flows through the primary side of the transformer T1, the LED load and the diode D9, thus forming a loop. Therefore, the LED constant-current drive circuit of the present invention always works at the critical continuous current mode, and limits the current passing through the LED load by controlling the maximum current value of the inductor current of the transformer. The inductor current of the transformer can not be changed suddenly, so the constant current is finally achieved by the linear variation of the inductor current of the transformer.

One skilled in the art will understand that the embodiment of the present invention as shown in the drawings and described above is exemplary only and not intended to be limited. It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An LED (light emitting diode) constant-current drive circuit, comprising:

a BUCK circuit consisting of a transformer (T1), a diode (D9), a capacitor (C5) and a field effect transistor (Q1);

a voltage limiting circuit consisting of a resistor (R1), a diode (D8), a capacitor (C1), a resistor (R3), a triode (Q2), a zener diode (DZ1) and a diode (D10); and a current limiting circuit consisting of a resistor (R4), a triode (Q3), a triode (Q4) and a resistor (R2), wherein when the field effect transistor (Q1) is turned on, a current flows through a primary side of the transformer (T1) and an LED load, and then flows through the field effect transistor (Q1) and the resistor (R2), and then flows back to a negative electrode of a power supply, and when the field effect transistor (Q1) is turned off, the current flows through the primary side of the transformer (T1), the LED load and the diode (D9), thus forming a loop, wherein a homonymous terminal at a primary side of the transformer (T1) is connected with a positive electrode of a power supply, the other terminal at the primary side of the transformer (T1) is connected with an anode of an LED load, a cathode of the LED load is connected with an anode of the diode (D9) and a drain electrode of the field effect transistor (Q1), a positive electrode and a negative electrode of the capacitor (C5) are respectively connected with the anode and the cathode of the LED load, a cathode of the diode (D9) is connected with the positive electrode of the power supply, a homonymous terminal at a secondary side of the transformer (T1) is connected with an anode of the diode (D8) and one end of the capacitor (C1), the other end at the secondary side of the transformer (T1) is connected with a source electrode of the field effect transistor (Q1), the source electrode of the field effect transistor (Q1) is connected with a negative electrode of the power supply via the resistor (R2), a gate electrode of the field effect transistor (Q1) is connected with the other end of the capacitor (C1), an emitter of the triode (Q2), a cathode of the diode (D10), one end of the resistor (R4) and an emitter of the triode (Q3), a base of the triode (Q3) is connected with the other end of the resistor (R4) and a collector of the triode (Q4), a collector of the triode (Q3) is connected with the source electrode of the field effect transistor (Q1) and a base of the triode (Q4), an emitter of the triode (Q4) is connected with the negative electrode of the power supply, a collector of the triode (Q2) is connected with a cathode of the diode (D8), one end of the resistor (R1) and one end of the resistor (R3), the other end of the resistor (R1) is connected with the positive electrode of the power supply, a base of the triode (Q2) is connected with the other end of the resistor (R3), an anode of the diode (D10) and a cathode of the zener diode (DZ1), and an anode of the zener diode (DZ1) is connected with the negative electrode of the power supply.

2. The LED constant-current drive circuit, as recited in claim 1, wherein the triode (Q3) is a PNP triode, and the triodes (Q2) and (Q4) are NPN triodes.

3. The LED constant-current drive circuit, as recited in claim 1, wherein the field effect transistor (Q1) is an enhanced PMOSFET (p-type metal-oxide-semiconductor field effect transistor).

4. The LED constant-current drive circuit, as recited in claim 2, wherein the field effect transistor (Q1) is an enhanced PMOSFET (p-type metal-oxide-semiconductor field effect transistor).

5. The LED constant-current drive circuit, as recited in claim 1, wherein the LED load is formed by a plurality of LEDs connected with each other in series.

6. The LED constant-current drive circuit, as recited in claim 2, wherein the LED load is formed by a plurality of LEDs connected with each other in series.

7. The LED constant-current drive circuit, as recited in claim 3, wherein the LED load is formed by a plurality of LEDs connected with each other in series.

8. The LED constant-current drive circuit, as recited in claim 4, wherein the LED load is formed by a plurality of LEDs connected with each other in series.

* * * * *